US008720570B2

(12) United States Patent
Seth et al.

(10) Patent No.: US 8,720,570 B2
(45) Date of Patent: May 13, 2014

(54) METHOD OF CORROSION MITIGATION USING NANOPARTICLE ADDITIVES

(75) Inventors: Kushal Seth, Houston, TX (US); Soma Chakraborty, Houston, TX (US); Allen Grabrysch, Houston, TX (US); Gaurav Agrawal, Aurora, CO (US)

(73) Assignee: Baker Hughes Incorporated, Houston, TX (US)

( * ) Notice: Subject to any disclaimer, the term of this patent is extended or adjusted under 35 U.S.C. 154(b) by 616 days.

(21) Appl. No.: 13/021,147

(22) Filed: Feb. 4, 2011

(65) Prior Publication Data

US 2012/0199357 A1 Aug. 9, 2012

(51) Int. Cl.
*E21B 37/00* (2006.01)

(52) U.S. Cl.
USPC ..... 166/304; 166/305.1; 977/963

(58) Field of Classification Search
None
See application file for complete search history.

(56) References Cited

U.S. PATENT DOCUMENTS

| | | | | |
|---|---|---|---|---|
| 3,077,454 | A | 2/1963 | Monroe | |
| 4,871,024 | A | 10/1989 | Cizek | |
| 5,954,147 | A * | 9/1999 | Overstreet et al. | 175/374 |
| 7,264,770 | B2 | 9/2007 | Andresen et al. | |
| 7,604,049 | B2 | 10/2009 | Vaidya et al. | |
| 7,655,158 | B2 | 2/2010 | Walker | |
| 2002/0060080 | A1 * | 5/2002 | Pliner et al. | 169/16 |
| 2008/0125335 | A1 * | 5/2008 | Bhavsar | 507/219 |
| 2008/0127475 | A1 * | 6/2008 | Griffo | 29/33 K |
| 2008/0129044 | A1 * | 6/2008 | Carcagno et al. | 285/94 |
| 2008/0213487 | A1 | 9/2008 | Park et al. | |
| 2008/0296023 | A1 * | 12/2008 | Willauer | 166/302 |
| 2009/0038858 | A1 * | 2/2009 | Griffo et al. | 175/371 |
| 2009/0324820 | A1 * | 12/2009 | Chartier | 427/239 |
| 2010/0119796 | A1 | 5/2010 | Lam et al. | |
| 2010/0129555 | A1 | 5/2010 | Huang | |
| 2010/0206553 | A1 * | 8/2010 | Bailey et al. | 166/244.1 |

FOREIGN PATENT DOCUMENTS

WO 2008/077005 A1 6/2008

OTHER PUBLICATIONS

International Search Report and Written Opinion of the International Searching Authority mailed on Sep. 14, 2012 for International Application No. PCT/US2012/023815 filed on Feb. 3, 2012.

Ramazan Asmatulu and Richard O. Claus, "Corrosion Protection of Materials by Applying Nanotechnology Associated Studies", Mat. Res. Soc. Symp. Proc. vol. 788 (2004) Materials Research Society. pp. 479-484.

A. Rostami, SPE, and H.A. Nasr-El-Din, SPE, Texas A& M Univeristy, "Review and Evaluation of Corrosion Inhibitors Used in Well Stimulation", Society of Petroluem Engineers, SPE 121726, 2009.

* cited by examiner

*Primary Examiner* — Angela M DiTrani
*Assistant Examiner* — Anuradha Ahuja
(74) *Attorney, Agent, or Firm* — Cantor Colburn LLP

(57) ABSTRACT

A method of mitigating corrosion of downhole articles includes mixing a plurality of nanoparticles into a first downhole fluid to form a nanoparticle fluid. The method also includes exposing a surface of a downhole article in a wellbore to the nanoparticle fluid. The method further includes disposing a barrier layer comprising a portion of the nanoparticles on the surface of the article and exposing the surface of the downhole article to a second downhole fluid, wherein the barrier layer is disposed between the second downhole fluid and the surface of the article.

24 Claims, 3 Drawing Sheets

METHOD OF CORROSION MITIGATION USING NANOPARTICLE ADDITIVES

BACKGROUND

It is well known that tubulars and equipment and components used in oil and gas production and completion are exposed to corrosive environments. Corrosive environments include various acidic environments associated with completion and production. For example, stimulation treatments consist of a variety of possible fluid systems designed to treat oil or gas wells by means of acidizing and/or fracturing in order to maximize production and return on investment. For example, acidizing is used to increase production in many situations. These include damage removal, completion and stimulation of horizontal wells, acid washing, matrix acidizing, fracture acidizing and gel breaking. In another example, production fluids are usually a mixture of liquid hydrocarbons, gas, and possibly water and other impurities, and may contain acid gases ($CO_2$ and $H_2S$) and brines of various salinities. In such environments, metal tubulars and other metal equipment and components will corrode, even those made from various stainless steels, highly alloyed specialty steels and steels with high Ni contents, including Ni-based superalloys. While the rate at which corrosion will occur depends on a number of factors such as the metallurgical composition, chemical nature of the corrosive agent, salinity, pH, temperature, flow rate, etc., some sort of corrosion almost inevitably occurs. One way to mitigate this problem consists of using corrosion inhibitors in the hydrocarbon production system.

It is known in the art that the corrosion of metal tubulars and other metal equipment and components, including the steel alloys described above, can be inhibited by treating them with corrosion inhibitors, including, for example, various oil soluble, water soluble or water-dispersible nitrogen-containing, phosphorus-containing or sulfur-containing corrosion inhibitors, or combinations thereof. While useful, corrosion inhibitors do not perform acceptably in all corrosive environments e.g. severe applications such as high shear and high flow rate environments.

In view of the wide variety of corrosive environments encountered in the completion and production arts, other solutions that may be used to mitigate corrosion in these environments are highly desirable, including those that may be used on a stand-alone basis or together with known corrosion inhibitors and methods of inhibiting corrosion.

SUMMARY

An exemplary embodiment of a method of mitigating corrosion of downhole articles is disclosed. The method includes mixing a plurality of nanoparticles into a first downhole fluid to form a nanoparticle fluid. The method also includes exposing a surface of a downhole article in a wellbore to the nanoparticle fluid. The method further includes disposing a barrier layer comprising a portion of the nanoparticles on the surface of the article and exposing the surface of the downhole article to a second downhole fluid, wherein the barrier layer is disposed between the second downhole fluid and the surface of the article.

BRIEF DESCRIPTION OF THE DRAWINGS

Referring now to the drawings wherein like elements are numbered alike in the several Figures.

DETAILED DESCRIPTION

Figure 1:
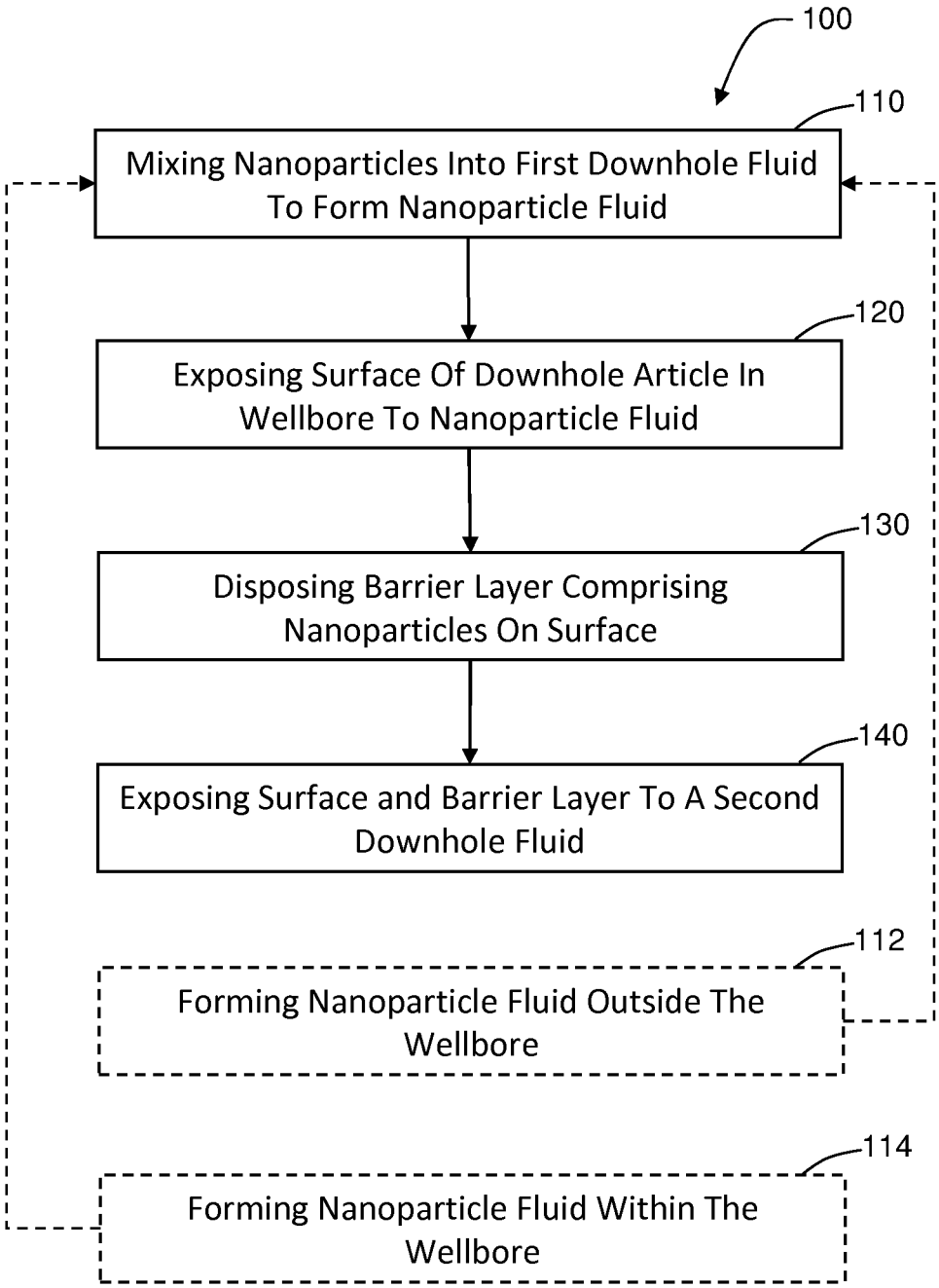
FIG. 1 is a flowchart of an exemplary embodiment of a method of mitigating corrosion of downhole articles as disclosed herein.
Figure 2:
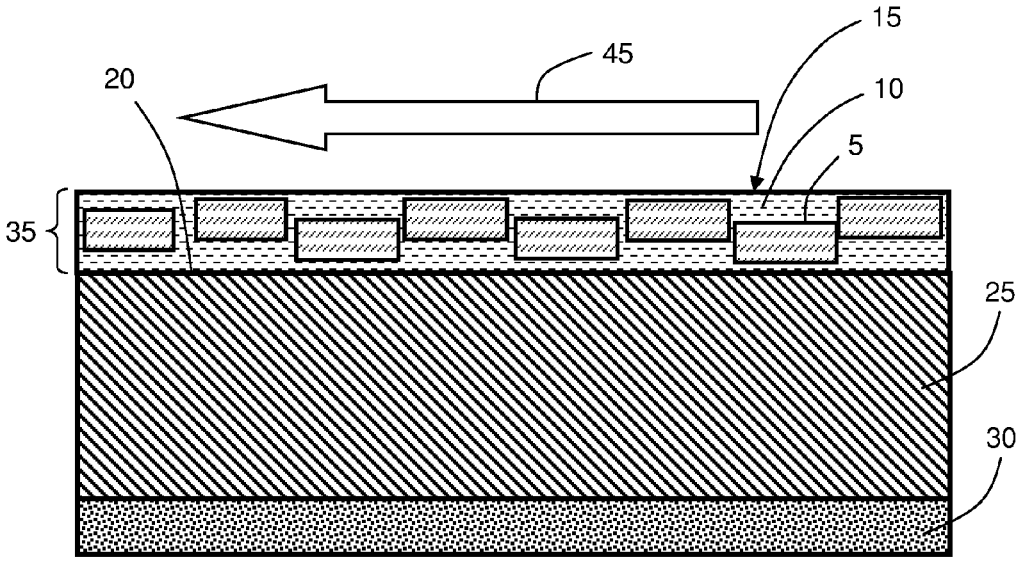
FIG. 2 is a schematic sectional illustration of an exemplary embodiment of a barrier layer comprising nanoparticles disposed on a surface of a downhole article as disclosed herein.
Figure 3:
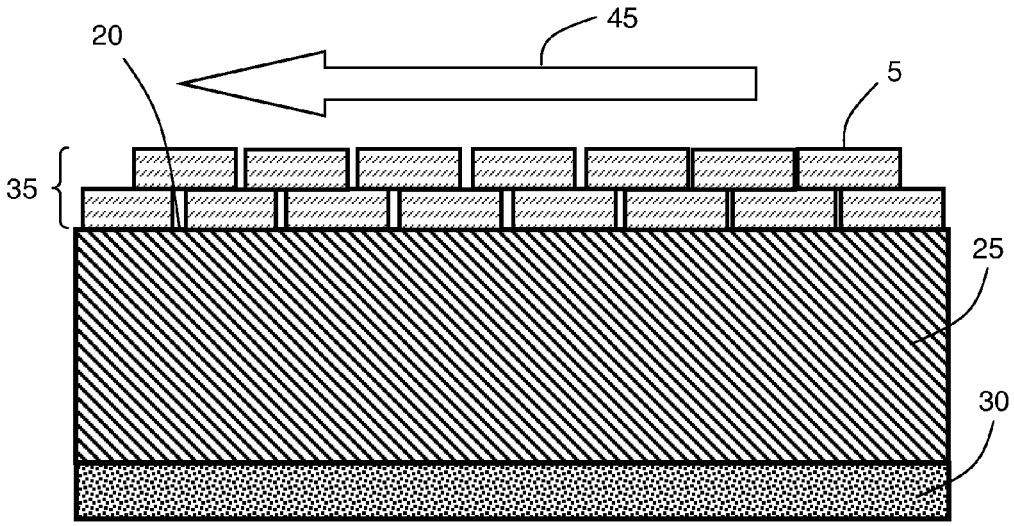
FIG. 3 is a schematic sectional illustration of a second exemplary embodiment of a barrier layer comprising nanoparticles disposed on a surface of a downhole article as disclosed herein.
Figure 4:
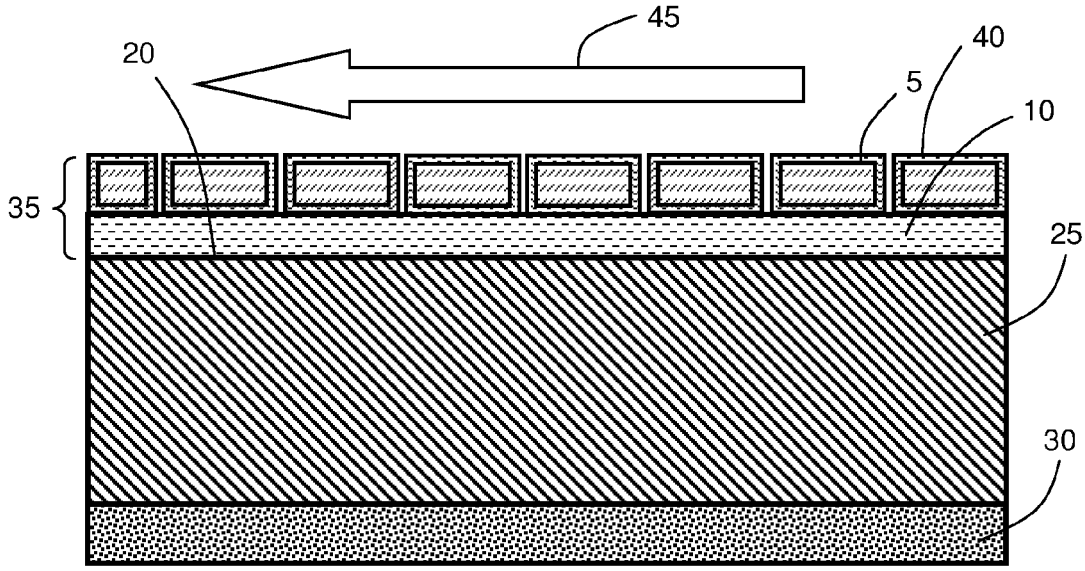
FIG. 4 is a schematic sectional illustration of a third exemplary embodiment of a barrier layer comprising nanoparticles disposed on a surface of a downhole article as disclosed herein.

Referring to FIGS. 1-5, an exemplary embodiment of a method 100 of mitigating corrosion of downhole articles is disclosed. Method 100 may be used to mitigate the corrosion of downhole articles, particularly metallic articles, and including all manner of tubulars and downhole devices, particularly downhole tools, components and the like. Method 100 mitigates corrosion by disposing a nanoparticle coating on the surface of the downhole article of interest, thereby limiting the exposure of the surface of the article to the corrosive downhole environment, particularly exposure to various corrosive fluids, including corrosive liquids, such as various organic and inorganic acids, and corrosive gases, such as $CO_2$ and $H_2S$.

Method 100 includes mixing 110 a plurality of nanoparticles 5 into a first downhole fluid 10 to form a nanoparticle fluid 15. Method 100 also includes exposing 120 a surface 20 of a downhole article 25 in a wellbore 30 to the nanoparticle fluid 15. Method 100 further includes disposing 130 a barrier layer 35 comprising a portion 40 of the nanoparticles 5 on the surface 20 of the article 25. Still further, method 100 includes exposing 140 the surface 20 of the downhole article 25 to a second downhole fluid 45, wherein the barrier layer 35 is disposed between the second downhole fluid 45 and the surface 20 of the article 25. The downhole article 25 may include any downhole article where corrosion protection is desired, and may include, for example, various tubulars, including various pipes, drill collars, sleeves and the like, as well as various downhole tools and components.

The first downhole fluid 10 and the second downhole fluid 45 may be any suitable downhole fluids for use in a wellbore, including fluids associated with well drilling, completion or production. First downhole fluid 10 and second downhole fluid 45 may each include an aqueous fluid or an organic fluid, or a combination thereof. These include all manner of downhole fluids, including natural or synthetic drilling muds, liquid or gaseous inorganic or organic acids, aqueous or organic solvents, fracturing fluids, including water to gels, foams, nitrogen, carbon dioxide or air liquid hydrocarbons (e.g., crude oil), gaseous hydrocarbons (e.g., natural gas), water, brines of various salinities or other impurities (e.g., acid gases such as $CO_2$ and $H_2S$), corrosion inhibitors, surfactants and the like, or combinations thereof. Of these downhole fluids, various acids are particularly notable, and may include, for example, an inorganic acid or an organic acid, or a combination thereof. An organic acid may be selected from a group consisting of acetic acid, formic acid, lactic acid, citric acid, oxalic acid, sulfonic acids, glycolic acid, chloroacetic acid, hydroxyacetic acid and combinations thereof. An inorganic acid may be selected from a group consisting of hydrochloric acid, sulfuric acid, nitric acid, phosphoric acid, hydrofluoric acid, hydrobromic acid, boric acid and combinations thereof.

In one exemplary embodiment, first downhole fluid 10 may be a carrier fluid selected specifically to enable mixing 100 of nanoparticles 5 and their transport to surface 20 for disposition thereon and may not have another purpose in completion or production operations, and second downhole fluid 45 may be one or more fluids of the types described above used in subsequent drilling, completion or production operations, for example. In another exemplary embodiment, first downhole fluid 10 may be a working fluid used in conjunction with drilling, completion or production operations and mixing 100 comprises introduction into this working fluid, and second downhole fluid 45 may be one or more fluids of the types described above used in subsequent drilling, completion or production operations, for example. In yet another embodiment, the first downhole fluid 10 and the second downhole fluid 45 may be the same fluid or flow stream, where mixing 100 of nanoparticles 5 into the fluid is done intermittently or continuously to dispose the barrier layer 35 between the later flows of the same fluid without the nanoparticles, i.e. second downhole fluid 45, and the surface 20 of the article 25.

Mixing 110 may include any suitable mixing method for mixing the nanoparticles 5 into the first downhole fluid 10. In one exemplary embodiment, mixing 110 may include premixing 112 the plurality of nanoparticles 5 and the first downhole fluid 10 outside the wellbore 30 to form the nanoparticle fluid 15. Premixing 112 may include any suitable mixing 110 outside the wellbore 30, such as batch mixing of nanoparticles 5 in first downhole fluid 10 to create nanoparticle fluid 15 outside of the wellbore 30, or continuous mixing of nanoparticles 5 in first downhole fluid 10 to create nanoparticles fluid 15 outside of the wellbore 30. Alternately, mixing 110 may include directly injecting 114 nanoparticles 5 into first downhole fluid 10 in the wellbore 30 to create nanoparticle fluid 15 within the wellbore 30.

In an exemplary embodiment, mixing 100 may include mixing nanoparticles 5 into a first downhole fluid 10 that includes a corrosion inhibitor. This is advantageous, since many of the methods used to apply corrosion inhibitors and the corrosion inhibitor materials themselves are configured to provide a protective film or barrier layer to the surface 20 of various articles 25, they are well-suited for transport of nanoparticles 5 to surface 20 for disposition thereon in a barrier layer 35 comprising nanoparticles 5. Corrosion inhibitors may be applied, for example, as a first downhole fluid 10 selected specifically to enable mixing 100 of nanoparticles 5 and their transport to surface 20 for disposition thereon and may not have another purpose in completion or production operations, or they may be incorporated in conjunction with a working fluid as described herein. An exemplary embodiment may be described in the context of an acidizing treatment, where the treatment normally involves injecting a first downhole fluid 10 comprising an aqueous acid composition including water, an acid (e.g., 15% HCl in water) and a corrosion inhibitor into a formation followed by a sufficient afterflush of a second downhole fluid 45 comprising water or hydrocarbon to clear the acid from wellbore tubulars. The corrosion inhibitor may be added to the acid to protect tubulars during exposure to acid. Any suitable corrosion inhibitor may be used. Examples of suitable corrosion inhibitors include those selected from a group consisting of acetylenic alcohols, Mannich reaction products, quaternary amine compounds, cinnamaldehyde, and combinations thereof. Some useful corrosion inhibitor bases are the Mannich reaction products, which may include, but are not limited to, the materials described, for example, in U.S. Pat. Nos. 3,077,454 and 7,655,158. The corrosion inhibitor may be added in any suitable amount. In an exemplary embodiment, an aqueous composition as described above may include a corrosion inhibitor in an amount from about 0.1 to about 5.0 percent by weight of the aqueous composition. The nanoparticles 5 may be added to a first fluid 10 comprising an aqueous composition in the example above in the amounts described herein. Other additives, such as anti-sludge agents, iron chelating agents, demulsifiers and mutual solvents are added as required and in the amounts needed for a specific formation.

Method 100 also includes exposing 120 a surface 20 of a downhole article 25 in a wellbore 30 to the nanoparticle fluid 15. Once the nanoparticles fluid 15 has been formed by mixing 110, exposing 120 may be done by any suitable method of introducing nanoparticle fluid 15 to the surface 20 of the downhole article 25 within the wellbore 30. In an exemplary embodiment, exposing 120 the surface of the downhole article 25 may include flowing the nanoparticle fluid 15 over the surface 20, particularly where the nanoparticle fluid 15 is configured to form a film or layer on the surface 20 of downhole article 25 on contact. As an example, this may include passing a flow stream of nanoparticle fluid 15, such as a corrosion inhibitor having a plurality of nanoparticles 5 dispersed therein, over a surface 20 defined by an inner or outer diameter of a drill string member, such as a casing or drill pipe, which is configured to contain flow streams of various drilling, completion or production fluids, or a surface 20 of various downhole tools and components used therewith. This may include, for example, filling a volume associated with the inner or outer diameter with the flow stream so as to ensure that the entirety of surface 20 is exposed to nanoparticles fluid 15. In another exemplary embodiment, exposing 120 the surface 20 of the downhole article 25 to nanoparticle fluid 15 may include spraying the entirety of surface 20 with nanoparticle fluid 15, such that filling the entirety of the volume of the drill string associated therewith is not required.

Method 100 also includes disposing 130 a barrier layer 35 comprising a portion 40 of the nanoparticles 5 on the surface 20 of the article 25. Only a portion 40 of nanoparticles 5 are disposed on the surface 20 because only a portion of nanoparticle fluid 5 contacts surface 20. Barrier layer 35 may include first downhole fluid 10 and nanoparticles 5, or may be formed substantially of nanoparticles 5 that are disposed on surface 20. In one exemplary embodiment, barrier layer 35 may include a fluid film comprising first downhole fluid 10 and nanoparticles 5 of first downhole fluid 10, wherein a fluid film of first downhole fluid 10, including nanoparticles 5, is configured for adherence to surface 20, and nanoparticles 5 are configured for retention within the film of first downhole fluid 10. As an example, a first downhole fluid 10 that is configured for physical or chemical bonding to surface 20, such as by functionalization, wherein the nanoparticles 5 are configured for physical or chemical bonding to the first downhole fluid 10. In another exemplary embodiment, first downhole fluid 10 acts as a carrier for delivery of nanoparticles 5 to surface 20, wherein nanoparticles 5 are disposed or deposited on surface 20 to form barrier layer 35, and first downhole fluid 10 does not comprise a significant portion of barrier layer 35. As an example, where first downhole fluid 10 is not configured for physical or chemical bonding to surface 20, and nanoparticles 5 are configured for physical or chemical bonding, such as by functionalization, to surface 20.

Figure 5:
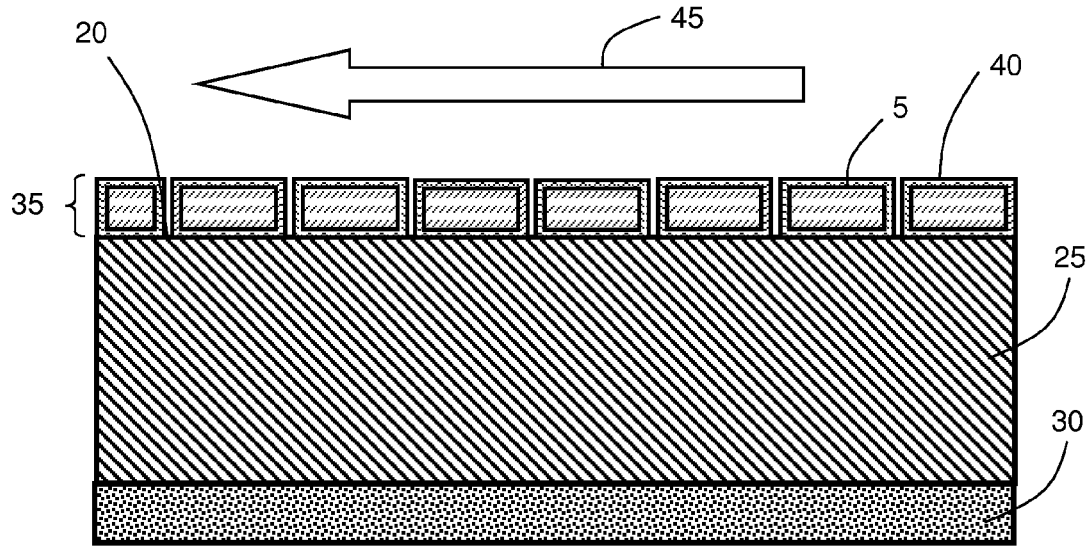
FIG. 5 is a schematic sectional illustration of a fourth exemplary embodiment of a barrier layer comprising nanoparticles disposed on a surface of a downhole article as disclosed herein.

Barrier layer 35, including nanoparticles 5, may form a physical barrier or a chemical barrier, or a combination thereof, to corrosive species in second downhole fluid 45. In an exemplary embodiment, barrier layer 35, including nanoparticles 5, may form a physical barrier to corrosive species in second downhole fluid 45, such as, for example, by reducing the surface area of surface 20 that is exposed to corrosive species in second downhole fluid 45. Alternately, barrier layer 35, including nanoparticles 5, may form a chemical barrier to corrosive species in second downhole fluid 45, such as, for example, by providing a material that may be attacked preferentially to surface 20 upon exposure to corrosive species in second downhole fluid 45, such as by providing a preferred reaction site, such as a sacrificial anode material. Depending upon the reactivity of nanoparticles 5 with second downhole fluid 45, nanoparticles 5 may be relatively inert, such that they do not require continuous replenishment, or they may be relatively reactive, such that they require periodic or continuous replenishment, as described herein. Nanoparticles 5 may be bonded to surface 20 to form barrier layer 35 by any suitable chemical or physical bonds or bonding mechanism. This may include being bound to surface 20 by surface tension effects or other bonds within a liquid film (FIG. 2); by chemical or physical bonds, or both, and including entropic ordering, directly to the surface 20 (FIG. 3); by chemical or physical bonds to a functional group 40 or groups disposed on nanoparticles 5 (FIG. 4); or by bonding to a film or layer, such as, for example, a layer of first fluid 10, that is disposed on surface 20 by chemical or physical bonds to a functional group 40 or groups disposed on nanoparticles 5 (FIG. 5).

Method 100 also includes exposing 140 the surface 20 of the downhole article 25 to a second downhole fluid 45, wherein the barrier layer 35 is disposed between the second downhole fluid 45 and the surface 20 of the article 25. Exposing 140 the second surface 20 to a second downhole fluid 45 may include exposure of second surface 20 to any second downhole fluid 45 after disposing nanoparticles 5 in barrier layer 35 on surface 20. Second downhole fluid 45 may include any downhole fluid; however, method 100 is particularly suited for protecting the surface 20 of article 25 where the second downhole fluid 45 includes species that may be corrosive with respect to this surface. In an exemplary embodiment, second downhole fluid 45 may also include various acids or acidizing fluids, such as, for example, a second acid that comprises an inorganic acid or an organic acid, or a combination thereof, and wherein the organic acid is selected from a group consisting of acetic acid, formic acid, lactic acid, citric acid, oxalic acid, sulfonic acids, glycolic acid, chloroacetic acid, hydroxyacetic acid and combinations thereof, and wherein the inorganic acid is selected from a group consisting of hydrochloric acid, sulfuric acid, nitric acid, phosphoric acid, hydrofluoric acid, hydrobromic acid, boric acid and combinations thereof. Acidizing is used to increase production in many situations. These include damage removal, completion and stimulation of horizontal wells, acid washing, pickling, matrix acidizing, fracture acidizing and gel breaking. Acid washing consists of either spotting acid over a certain wellbore zone or circulating acid back and forth over the desired zone, and allowing the acid to react. Matrix acidizing is accomplished by injecting the acid into the formation at a rate and pressure below that required to fracture the formation. The desired effect is radial penetration of the acid system into the formation. Acid fracturing is a term used to describe the technique. The fluid is injected at a pressure and rate great enough to fracture the formation or open existing fractures. The acid reacting with the acid-soluble fracture walls produces a highly conductive channel to the wellbore. For example, matrix acidizing of sandstone, limestone, or mixtures has been an effective means of stimulating oil and gas reservoirs. Acids are used to dissolve minerals which are production restricting and/or formation damaging at or near the wellbore. This usually results in an increase in permeability and porosity in the formation with subsequent increases in production.

The nanoparticles 5 may include carbon, clay, metal, inorganic or polysilsesquioxanes nanoparticles, or a combination thereof. Carbon nanoparticles may include various graphite, graphene, fullerene or nanodiamond nanoparticles, or a combination thereof. Fullerene carbon nanoparticles may include buckeyballs, buckeyball clusters, buckeypapers, single-wall nanotubes or multi-wall nanotubes, or a combination thereof. Inorganic nanoparticles may include, for example, various metallic carbide, nitride, carbonate or oxide nanoparticles, or a combination thereof.

As used herein, the term "nanoparticle" means and includes any particle having an average particle size of about 1 μm or less. In one exemplary embodiment, the nanoparticles used herein may have an average particle size of about 0.01 to about 500 nm, and more particularly about 0.1 to about 250 nm, and even more particularly about 1 to about 150 nm.

The nanoparticles 5 used herein may have any suitable shape, including various spherical, symmetrical, irregular, or elongated shapes. They may have a low aspect ratio (i.e., largest dimension to smallest dimension) of less than 10 and approaching 1 in various spherical particles. They may also have a two-dimensional aspect ratio (i.e., diameter to thickness for elongated nanoparticles such as nanotubes or diamondoids; or ratios of length to width, at an assumed thickness or surface area to cross-sectional area for plate-like nanoparticles such as, for example, nanographene or nanoclays) of greater than or equal to 10, specifically greater than or equal to 100, more specifically greater than or equal to 200, and still more specifically greater than or equal to 500. Similarly, the two-dimensional aspect ratio for such nanoparticles may be less than or equal to 10,000, specifically less than or equal to 5,000, and still more specifically less than or equal to 1,000.

The nanoparticles 5 may comprise any suitable amount of the first downhole fluid 10. In one exemplary embodiment the nanoparticles 5 comprise about 0.1 to about 25 percent by weight of the first downhole fluid 10.

Fullerene nanoparticles, as disclosed herein, may include any of the known cage-like hollow allotropic forms of carbon possessing a polyhedral structure. Fullerenes may include, for example, polyhedral buckeyballs of from about 20 to about 100 carbon atoms. For example, $C_{60}$ is a fullerene having 60 carbon atoms and high symmetry ($D_{5h}$), and is a relatively common, commercially available fullerene. Exemplary fullerenes include, for example, $C_{30}$, $C_{32}$, $C_{34}$, $C_{38}$, $C_{40}$, $C_{42}$, $C_{44}$, $C_{46}$, $C_{48}$, $C_{50}$, $C_{52}$, $C_{60}$, $C_{70}$, $C_{76}$, and the like. Fullerene nanoparticles may also include buckeyball clusters. A carbon nanotube is a carbon-based, tubular fullerene structure having open or closed ends and which may be inorganic or made entirely or partially of carbon, and may include also components such as metals or metalloids. Nanotubes, including carbon nanotubes, may be single-wall nanotubes (SWNTs) or multi-wall nanotubes (MWNTs).

A graphite nanoparticle includes a cluster of plate-like sheets of graphite, in which a stacked structure of one or more layers of the graphite, which has a plate-like two dimensional structure of fused hexagonal rings with an extended delocalized π-electron system, layered and weakly bonded to one another through π-π stacking interaction. Graphene nanoparticles, may be a single sheet or several sheets of graphite having nano-scale dimensions, such as an average particle size (average largest dimension) of less than e.g., 500 nanometers (nm), or in other embodiments may have an average largest dimension greater than about 1 μm. Nanographene may be prepared by exfoliation of nanographite or by catalytic bond-breaking of a series of carbon-carbon bonds in a carbon nanotube to form a nanographene ribbon by an "unzipping" process, followed by derivatization of the nanographene to prepare, for example, nanographene oxide.

Diamondoids may include carbon cage molecules such as those based on adamantane ($C_{10}H_{16}$), which is the smallest unit cage structure of the diamond crystal lattice, as well as variants of adamantane (e.g., molecules in which other atoms (e.g., N, O, Si, or S) are substituted for carbon atoms in the molecule) and carbon cage polyadamantane molecules including between 2 and about 20 adamantane cages per molecule (e.g., diamantane, triamantane, tetramantane, pentamantane, hexamantane, heptamantane, and the like).

Polysilsesquioxanes, also referred to as polyorganosilsesquioxanes or polyhedral oligomeric silsesquioxanes (POSS) derivatives are polyorganosilicon oxide compounds of general formula $RSiO_{1.5}$ (where R is an organic group such as methyl) having defined closed or open cage structures (closo or nido structures). Polysilsesquioxanes, including POSS structures, may be prepared by acid and/or base-catalyzed condensation of functionalized silicon-containing monomers such as tetraalkoxysilanes including tetramethoxysilane and tetraethoxysilane, alkyltrialkoxysilanes such as methyltrimethoxysilane and methyltrimethoxysilane.

Clay nanoparticles may be hydrated or anhydrous silicate minerals with a layered structure and may include, for example, alumino-silicate clays such as kaolins including hallyosite, smectites including montmorillonite, illite, and the like. Clay nanoparticles may be exfoliated to separate individual sheets, or may be non-exfoliated, and further, may be dehydrated or included as hydrated minerals. Other mineral fillers of similar structure may also be included such as, for example, talc, micas, including muscovite, phlogopite, or phengite, or the like.

Inorganic nanoparticles may also be included in the composition. Any suitable inorganic nanoparticle material may be used. An exemplary inorganic nanoparticle may include a metal or metalloid (metallic) boride such as titanium boride, tungsten boride and the like; a metal or metalloid carbide such as tungsten carbide, silicon carbide, boron carbide, or the like; a metal or metalloid nitride such as titanium nitride, boron nitride, silicon nitride, or the like; a metal or metalloid oxide such as aluminum oxide, silicon oxide or the like; a metal carbonate, a metal bicarbonate, or a metal nanoparticle, such as iron, cobalt or nickel, or an alloy thereof, or the like.

In other embodiments, the nanoparticles 5 may also be functionalized to form a derivatized nanoparticle using either inorganic or organic materials. For example, the nanoparticles 5 described herein may be functionalized by being coated with an inorganic material, such as a metal boride, carbide, a nitride, carbonate, bicarbonate or a metal, or a combination thereof. As another example, the nanoparticles 5 may also be functionalized to form a derivatized nanoparticle that includes an organic functional group, such as a carboxy, epoxy, ether, ketone, amine, hydroxy, alkoxy, alkyl, lactone or aryl group, or a polymeric or oligomeric group thereof, or a combination thereof.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of mitigating corrosion of downhole articles, comprising:

mixing a plurality of nanoparticles other than clay nanoparticles into a first downhole fluid to form a nanoparticle fluid;

exposing a surface of a downhole article in a wellbore to the nanoparticle fluid;

disposing a barrier layer comprising a portion of the nanoparticles on the surface of the downhole article; and exposing the surface of the downhole article to a second downhole fluid, wherein the barrier layer is disposed between the second downhole fluid and the surface of the downhole article.

2. The method of claim 1, wherein the mixing comprises premixing the plurality of nanoparticles and the first downhole fluid outside the wellbore to form the nanoparticle fluid.

3. The method of claim 1, wherein the mixing comprises mixing the plurality of nanoparticles and the first downhole fluid within the wellbore.

4. The method of claim 3, wherein the mixing comprises continuous injection of the plurality of nanoparticles into the first downhole fluid within the wellbore.

5. The method of claim 1, wherein the nanoparticles comprise carbon, metal, inorganic or polysilsesquioxanes nanoparticles, or a combination thereof.

6. The method of claim 5, wherein the nanoparticles comprise carbon nanoparticles, and the carbon nanoparticles comprise graphene, fullerene or nanodiamond nanoparticles, or a combination thereof.

7. The method of claim 6, wherein the carbon nanoparticles comprise fullerene nanoparticles, and the fullerene nanoparticles comprise buckeyballs, buckeyball clusters, buckeypapers, single-wall nanotubes or multi-wall nanotubes, or a combination thereof.

8. The method of claim 1, wherein the nanoparticles comprise functionalized carbon nanoparticles.

9. The method of claim 8, wherein the functionalized carbon nanoparticles comprise graphene, fullerene or nanodiamond nanoparticles, or a combination thereof.

10. The method of claim 9, wherein the functionalized carbon nanoparticles comprise fullerene nanoparticles comprising buckeyballs, buckeyball clusters, buckeypapers, single-wall nanotubes or multi-wall nanotubes, or a combination thereof.

11. The method of claim 8, wherein the functionalized carbon nanoparticles comprise a functional group selected from a group consisting of carboxy, epoxy, ether, ketone, amine, hydroxy, alkoxy, alkyl, lactone, aryl, functionalized polymeric or oligomeric groups, and combinations thereof.

12. The method of claim 1, wherein the first downhole fluid is an aqueous fluid or an organic fluid, or a combination thereof.

13. The method of claim 1, wherein the first downhole fluid comprises a corrosion inhibitor.

14. The method of claim 13, wherein the corrosion inhibitor is selected from a group consisting of acetylenic alcohols, Mannich reaction products, quaternary amine compounds, cinnamaldehyde, and combinations thereof.

15. The method of claim 1, wherein first downhole fluid comprises a first acid.

16. The method of claim 15, wherein the first acid comprises an inorganic acid or an organic acid, or a combination thereof, and wherein the organic acid is selected from a group consisting of acetic acid, formic acid, lactic acid, citric acid, oxalic acid, sulfonic acids, glycolic acid, chloroacetic acid, hydroxyacetic acid and combinations thereof, and wherein the inorganic acid is selected from a group consisting of hydrochloric acid, sulfuric acid, nitric acid, phosphoric acid, hydrofluoric acid, hydrobromic acid, boric acid and combinations thereof.

17. The method of claim 1, wherein the first downhole fluid comprises an aqueous composition comprising water, a first acid and a corrosion inhibitor.

18. The method of claim 17, wherein the first acid comprises an inorganic acid or an organic acid, or a combination thereof, and wherein the organic acid is selected from a group consisting of acetic acid, formic acid, lactic acid, citric acid, oxalic acid, sulfonic acids, glycolic acid, chloroacetic acid, hydroxyacetic acid and combinations thereof, and wherein the inorganic acid is selected from a group consisting of hydrochloric acid, sulfuric acid, nitric acid, phosphoric acid, hydrofluoric acid, hydrobromic acid, boric acid and combinations thereof.

19. The method of claim 17, wherein the corrosion inhibitor is selected from a group consisting of acetylenic alcohols, Mannich reaction products, quaternary amine compounds, cinnamaldehyde, and combinations thereof.

20. The method of claim 17, wherein the corrosion inhibitor is present in the aqueous composition in an amount from about 0.1 to about 5.0 percent by weight of the aqueous composition.

21. The method of claim 1, wherein the second downhole fluid comprises an acid.

22. The method of claim 21, wherein the second acid comprises an inorganic acid or an organic acid, or a combination thereof, and wherein the organic acid is selected from a group consisting of acetic acid, formic acid, lactic acid, citric acid, oxalic acid, sulfonic acids, glycolic acid, chloroacetic acid, hydroxyacetic acid and combinations thereof, and wherein the inorganic acid is selected from a group consisting of hydrochloric acid, sulfuric acid, nitric acid, phosphoric acid, hydrofluoric acid, hydrobromic acid, boric acid and combinations thereof.

23. The method of claim 1, wherein the downhole article comprises a tubular or downhole tool, or a combination thereof.

24. A method of mitigating corrosion of downhole articles, comprising:

mixing a plurality of nanoparticles other than clay nanoparticles into a first downhole fluid other than water to form a nanoparticle fluid;

exposing a surface of a downhole article in a wellbore to the nanoparticle fluid;

disposing a barrier layer comprising a portion of the nanoparticles on the surface of the downhole article; and exposing the surface of the downhole article to a second downhole fluid, wherein the barrier layer is disposed between the second downhole fluid and the surface of the downhole article.

* * * * *